US009296970B2

(12) United States Patent
Grundei et al.

(10) Patent No.: US 9,296,970 B2
(45) Date of Patent: Mar. 29, 2016

(54) USE OF NANOSCALE MATERIALS IN A COMPOSITION FOR PREVENTING SYMPTOMS OF FATIGUE IN THE SURFACE-CLOSED STRUCTURE OF DRIVE ELEMENTS

(75) Inventors: Stefan Grundei, Mering (DE); Carla Krutzsch, Taufkirchen (DE); Martin Schmidt-Amelunxen, Rohrmoos/Arzbach (DE)

(73) Assignee: Kluber Lubrication Munchen SE & Co. KG, Munich (DE)

( * ) Notice: Subject to any disclaimer, the term of this patent is extended or adjusted under 35 U.S.C. 154(b) by 169 days.

(21) Appl. No.: 14/122,603

(22) PCT Filed: May 9, 2012

(86) PCT No.: PCT/EP2012/001997
§ 371 (c)(1),
(2), (4) Date: Feb. 19, 2014

(87) PCT Pub. No.: WO2012/163468
PCT Pub. Date: Dec. 6, 2012

(65) Prior Publication Data

US 2014/0162914 A1 Jun. 12, 2014

(30) Foreign Application Priority Data

Jun. 1, 2011 (EP) ..... 10 2011 103 215

(51) Int. Cl.
*C10M 125/26* (2006.01)
*C10M 125/10* (2006.01)
(Continued)

(52) U.S. Cl.
CPC ..... *C10M 141/02* (2013.01); *C10M 125/10* (2013.01); *C10M 125/26* (2013.01);
(Continued)

(58) Field of Classification Search
CPC ..... C10M 141/02; C10M 147/02; C10M 125/10; C10M 125/26; C10M 2201/062; C10M 2209/1033; C10M 2209/1045; C10M 2201/105; C10M 2227/04; C10M 2229/02; C10M 2209/1055; C10N 2270/00; C10N 2230/04; C10N 2220/08; C10N 2230/12; C10N 2220/082; C10N 2230/06; C10N 2220/084; C10N 2270/02; C10N 2230/02
USPC ..... 508/126, 136, 161, 165, 178
See application file for complete search history.

(56) References Cited

U.S. PATENT DOCUMENTS

2008/0161213 A1* 7/2008 Jao et al. ..... 508/165
2008/0269086 A1* 10/2008 Adhvaryu ..... 508/155
(Continued)

FOREIGN PATENT DOCUMENTS

CN 102041140 5/2011
WO WO2008127395 A2 10/2008
WO WO 2010077773 A1 * 7/2010

OTHER PUBLICATIONS

The Tribology Properties of Alumina/Silica composite nanoparticles as Iburicant additives Jiao, Zheng, Wang, Guan, Cao Applied Surface Science 257 (2011) 5720-5725 available online Jan. 26, 2011.*
(Continued)

*Primary Examiner* — Pamela H Weiss
(74) *Attorney, Agent, or Firm* — Maginot, Moore & Beck, LLP

(57) ABSTRACT

A composition for prevention or reduction of fatigue damage, especially trench formation or micropitting, of the surfaces of drive elements, is provided that comprises 0.1 to 40% by weight of surface-modified nanoparticles, and 99.9 to 60% by weight of a carrier material suitable for application to the drive element surfaces.

8 Claims, 5 Drawing Sheets

(51) Int. Cl.
*C10M 171/06* (2006.01)
*C10M 141/02* (2006.01)
*C10M 147/02* (2006.01)

(52) U.S. Cl.
CPC ..... *C10M147/02* (2013.01); *C10M 2201/062* (2013.01); *C10M 2201/105* (2013.01); *C10M 2209/1033* (2013.01); *C10M 2209/1045* (2013.01); *C10M 2227/04* (2013.01); *C10M 2229/02* (2013.01); *C10N 2220/08* (2013.01); *C10N 2220/082* (2013.01); *C10N 2220/084* (2013.01); *C10N 2230/02* (2013.01); *C10N 2230/04* (2013.01); *C10N 2230/06* (2013.01); *C10N 2230/12* (2013.01); *C10N 2270/00* (2013.01); *C10N 2270/02* (2013.01)

(56) References Cited

U.S. PATENT DOCUMENTS

2010/0187925 A1* 7/2010 Tingler et al. ..... 310/87
2011/0118156 A1* 5/2011 Ruhle et al. ..... 508/136
2011/0257054 A1* 10/2011 Baran et al. ..... 508/139

OTHER PUBLICATIONS

Li, Xiaohong, et al., "Surface-Modification in situ of nano-SiO2 and its Structure and Tribological Properties," Applied Surface Science vol. 252 , No. 22, Sep. 15, 2006, pp. 7856-7861.
International Search Report relating to European application No. EP2012001997, mailed Dec. 12, 2013.

* cited by examiner

| | | | Size (d.nm) | %Intensity | Witdth (d.nm) |
|---|---|---|---|---|---|
| Z-Average (d.nm): | 34.98 | Peak 1 | 50.87 | 100.0 | 20.93 |
| PdI: | 0.281 | Peak 2 | 0.000 | 0.0 | 0.000 |
| Intercept: | 0.965 | Peak 3 | 0.000 | 0.0 | 0.000 |
| Result quality | Good | | | | |

| | | | Size (d.nm) | %Intensity | Witdth (d.nm) |
|---|---|---|---|---|---|
| Z-Average (d.nm): | 45.91 | Peak 1 | 52.08 | 100.0 | 18.51 |
| PdI: | 0.108 | Peak 2 | 0.000 | 0.0 | 0.000 |
| Intercept: | 0.928 | Peak 3 | 0.000 | 0.0 | 0.000 |
| Result quality | Good | | | | |

| | | | Size (d.nm) | %Intensity | Witdth (d.nm) |
|---|---|---|---|---|---|
| Z-Average (d.nm): | 43.27 | Peak 1 | 49.78 | 100.0 | 19.00 |
| PdI: | 0.122 | Peak 2 | 0.000 | 0.0 | 0.000 |
| Intercept: | 0.928 | Peak 3 | 0.000 | 0.0 | 0.000 |
| Result quality | Good | | | | |

| | | | Size (d.nm) | %Intensity | Witdth (d.nm) |
|---|---|---|---|---|---|
| Z-Average (d.nm): | 41.49 | Peak 1 | 74.14 | 99.4 | 74.48 |
| PdI: | 0.413 | Peak 2 | 3710 | 0.6 | 1216 |
| Intercept: | 0.913 | Peak 3 | 0.000 | 0.0 | 0.000 |
| Result quality | Good | | | | |

USE OF NANOSCALE MATERIALS IN A COMPOSITION FOR PREVENTING SYMPTOMS OF FATIGUE IN THE SURFACE-CLOSED STRUCTURE OF DRIVE ELEMENTS

BACKGROUND

The present invention relates to the use of nanoscale materials in a composition which is applied to the surfaces of drive elements in order to prevent fatigue damage thereon. More particularly, this application protects the surfaces of drive elements against the formation of micropitting (gray staining, surface fatigue) and trench formation. The occurrence of fatigue damage on these surfaces is prevented or reduced as a result.

In the case of drive elements, excessively high mechanical stresses result in two kinds of damage:

1) Scuffing and wear, in the case of which the damage proceeds from the surface of the contact faces.
2) Fatigue damage, which originates in the structure below the stressed faces and ultimately ends in excavations, for example pitting, micropitting, trench formation.

For reduction of wear and scuffing, there is a multitude of additives and solid lubricants which are well known and frequently used.

To prevent fatigue damage, only very few effective measures are known. One measure is to increase the lubrication film thickness.

Fatigue wear (pitting) arises through local overloading of the material by periodic compressive stress. The fatigue of the material becomes visible through micropitting (gray staining, surface fatigue) or trenches on the surface of the material. At first, fine cracks form in the metal lattice 20 to 40 μm below the surface, and these lead to material excavation. The small, microscopically visible excavations on the tooth flank, referred to as micropitting or gray staining, are recognizable as matt gray regions. In the case of gear systems, micropitting can be observed on tooth flanks virtually in all speed ranges. In roller bearings too, very shallow excavations occur in the form of micropitting on the raceway in the region of the sliding contact. These connections are described in detail in DE 10 2007 036 856 A1 and the literature cited therein.

To improve the viscosity properties, different additives are used in lubricants in order to avoid or at least minimize the abovementioned damage in roller bearings, cogs, gears and the like. In this context, the fatigue damage which is referred to as micropitting formation and trench formation is that which leads to the most serious material impairments through the cracks which arise.

To avoid this fatigue damage, the following measures can be taken:

- lowering the contact forces,
- suitable selection of lubricant,
- adequate lubricant supply,
- favorable positioning and configuration of the lubrication sites,
- avoidance of unlubricated states.

With regard to the avoidance of fatigue phenomena, various studies have been undertaken, some of which have been attempts to improve the lubricity of lubricants by addition of various additives. More particularly, additives with which the friction between the components can be reduced or which have an improved viscosity have been examined.

For instance, DE-A 1 644 934 describes organophosphates as additives in lubricants, which are added as antifatigue additives.

DE 10 2007 036 856 A1, which has already been cited above, discloses the addition of polymers having ester groups, which are used as antifatigue additives in lubricants.

US 2003/0092585 A1 discloses thiazoles as antipitting additives.

EP 1 642 957 A1 relates to the use of $MoS_2$ and molybdenum dithiocarbamate, which are used as additives in urea greases for power trains.

The above-described additives known from the prior art, such as organophosphates and thiazoles, are thermally unstable, being organic substances. Furthermore, they can vaporize under the operating conditions or can, as conventional antiwear additives, react particularly with the metal surfaces, meaning that they react predominantly at the roughness tips which come into contact, since sufficient energy is available there for a chemical reaction with the metallic friction layer as a result of the flash temperatures which occur. They can therefore at best act in a minor role as antipitting additives. Solid lubricants such as molybdenum disulfide, in contrast, because of their density, have a tendency to settle out of oil formulations and can also be corrosive. Since the solid particles are used with particle sizes in the μm range, there is a significant influence on the flow characteristics and an increase in viscosity, and also a departure from newtonian flow characteristics. This behavior worsens the availability of the additive in the lubrication gap. SEM studies on the surfaces of the metallic friction partners show that these structures or depressions have with dimensions distinctly below 1 μm. These depressions are not accessible to the μm-size solid lubricant particles.

SUMMARY

Proceeding from the prior art, it is an object of the present invention to provide a composition which can be applied to the surfaces of drive elements in order thus to prevent or reduce the fatigue phenomena of "micropitting" and "trench formation" on these drive elements. This composition should not include any volatile organic compounds as an antipitting additive, and the antipitting additives should be in a liquid phase having newtonian flow characteristics. As a result, they can penetrate into the above-described structures or depressions and reinforce the metal structure therein.

The present invention accordingly provides for the use of a composition which is applied to the surface of the drive elements in order to prevent or to reduce fatigue phenomena. It has been found that, surprisingly, the application of a composition comprising surface-modified nanoparticles and a carrier material prevents or reduces fatigue damage, such as micropitting formation and trench formation.

The surface-modified nanoparticles present in the composition are oxidic nanoparticles. They may be selected from silicon dioxide, zinc oxide and aluminum oxide. Especially suitable for surface modification are surface-modifying reagents such as alkyl-, aryl-, alkylarylsilanes having at least 1 to 3 of these alkyl, aryl or alkylaryl groups, which may additionally contain functional groups, especially thio groups, phosphate groups, and which are used individually or in combination. The thio or phosphate groups optionally present may additionally enter into a reaction with the metal surface to be protected. In the surface modification, the amount of modifying reagent per $nm^2$ of the particle surface is 0.1 to 10 molecules of the modifying reagent, preferably 0.3 to 5 molecules. The effect of this chemical modification is that the nanoparticles are present in discrete form in various base oils, i.e. without aggregation.

It has also been found that the composition may comprise mixtures of nanoparticles which are both different from one another and have different particle sizes.

The surface-modified nanoparticles have a mean particle size of 10 nm to less than 200 nm, preferably 10 nm to 100 nm. The particle size of nanoparticles can be determined by different processes. Dry processes such as measurement with a transmission electron microscope often give smaller particle sizes than measurement by dynamic light scattering, since a solvent shell bonded in a relatively fixed manner in the latter process causes greater values. The particle sizes reported in this application are generally based on results with dynamic light scattering.

The carrier material is selected from the group consisting of mineral oils, synthetic hydrocarbons, polyglycols, esters and ester compounds, PFPE, native oils and derivatives of native oils, aromatics-containing oils such as phenyl ethers, and mixtures thereof. Particular preference is given to using, as the carrier material, polyglycols, esters and synthetic hydrocarbons.

The inventive composition comprising the nanoparticles and the carrier can additionally be incorporated into a lubricant. This lubricant may take the form of greases, pastes, oils, and is selected from the group consisting of a lubricant oil or mixtures of lubricant oils, polyglycols, silicone oils, perfluoropolyethers, mineral oils, esters, synthetic hydrocarbons, phenyl ethers, native oils and derivatives of native oils, organic or inorganic thickeners, especially PTFE, graphite, metal oxides, boron nitride, molybdenum disulfide, phosphates, silicates, sulfonates, polyimides, metal soaps, metal complex soaps, ureas and mixtures thereof, solid lubricants such as graphite, $MoS_2$.

Particular preference is given to compositions which are used as a concentrate in one of the abovementioned lubricants.

In addition, soluble additives, especially aromatic amines, phenols, phosphates, and also anticorrosives, antioxidants, antiwear agents, friction reducers, agents for protection against metal influences, UV stabilizers, may be present in the composition.

The inventive composition consists generally of 0.1 to 40% by weight of surface-modified nanoparticles, especially 2 to 20% by weight of surface-modified nanoparticles, and 99.9% to 60% by weight of carrier material, especially 8 to 80% by weight of carrier material.

The nanoparticles can be introduced into the carrier material in two ways. Firstly, dispersions of nanoparticles can be produced in a sol-gel process and be surface-modified in the dispersion, and then the dispersion can be produced by adding the carrier material and drawing off the volatile solvents. This process can be referred to as redispersion and has the advantage that the nanoparticles are always wetted by liquid, and hence the risk of agglomeration is reduced. This process is described in the examples which follow.

Alternatively, after the modification of the surfaces, the solvents can be removed and the dry particles isolated. The particles can be incorporated by dispersion under shear, optionally at elevated temperature. Which process should be employed depends on a wide variety of factors, such as particle type, particle sizes, the nature and extent of the surface coverage and the chemical nature of the carrier material, and has to be determined individually.

This composition can then be introduced into any lubricant, such that, based on the final formulation, 0.1-10% nanoparticles, 99.9-90% lubricant are present.

The production of $SiO_2$ nanoparticles is described, for example, in: W. Stöber, A. Fink, *Journal of Colloid and Interface Science* 26, 62-69, 1968 or in: Zichen Wang et al. *Materials Letters* 61, 2007, 506-510, the entire disclosures of which are incorporated herein by reference. The disadvantage when using the Stöber process in the production is that the dispersions formed have low contents of $SiO_2$ nanoparticles, generally around a 3% mass content of $SiO_2$. The stability of the nanoparticles, and also the nature of the particles which form, is determined by the choice of reaction conditions, here particularly of the pH.

Figure 1:
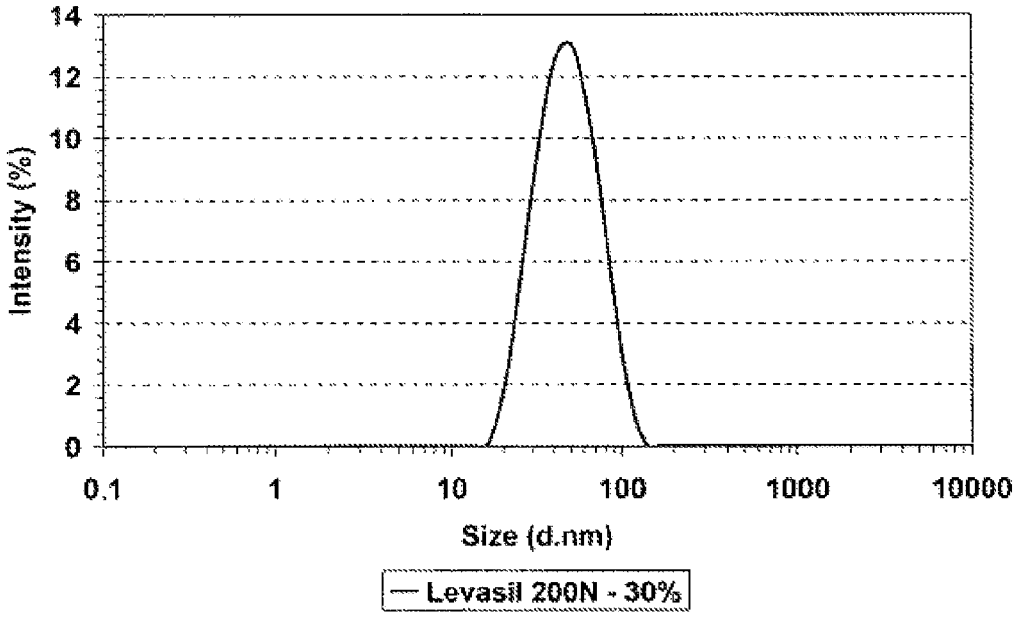
FIG. 1: particle size distribution of a batch of Levasil 200N/30%

There are also commercial sources of nanoparticulate $SiO_2$ dispersions. Under the Levasil trade name (Akzo Nobel, formerly HC Starck), aqueous dispersions having solids contents of up to 50% are supplied. Levasil 200N/30% is, for example, a 30% dispersion stabilized with ammonia. The particle size is reported as about 55 nm. This size distribution is confirmed by the diagram in FIG. 1, which shows particle analysis with a Malvern Zetasizer.

Likewise available from Akzo Nobel under the Bindzil trade name are $SiO_2$ nanodispersions having particle sizes around 10 nm and solids contents up to 40%, the surfaces of which have been modified with epoxy silane.

The production of the aqueous dispersions is also described in EP 1 554 221 B1 and EP 1 554 220 B1, the entire disclosures of which are incorporated herein by reference.

EXAMPLE 1

Process for Producing Unmodified $SiO_2$ Nanoparticles from Tetraethyl Orthosilicate (Stöber Process)

Figure 2:
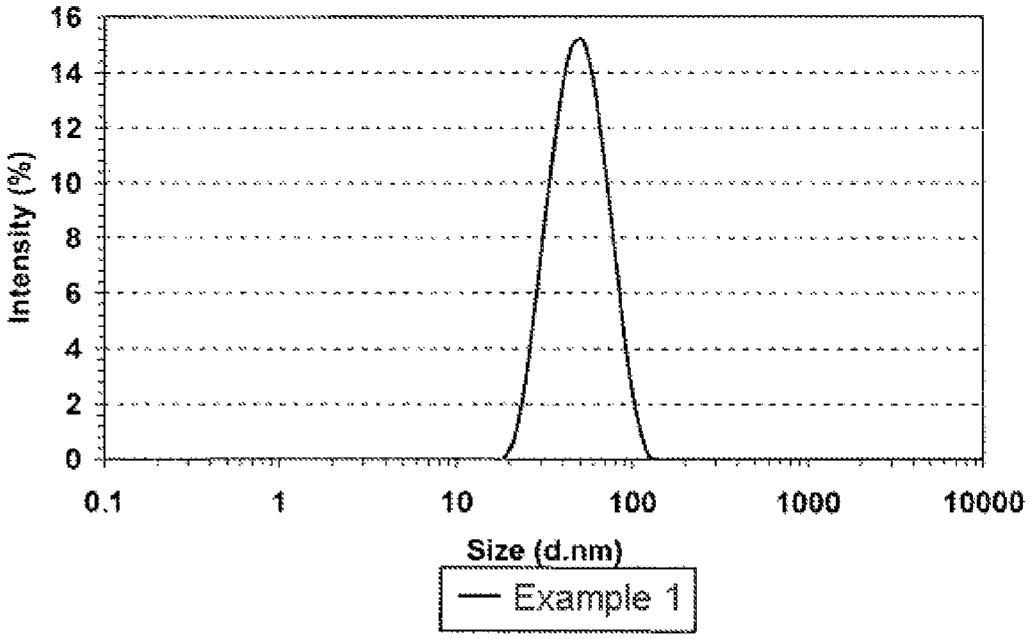
FIG. 2: particle size of the $SiO_2$ dispersion, the particles having been produced by the Stöber process and having been determined by dynamic light scattering (example 1)

A 2 l three-neck flask with precision glass stirrer and reflux condenser is initially charged with 612.4 g of ethanol, 113.47 g of dist. $H_2O$, 21.67 g of $NH_3$ (25%), which are heated to reflux. A solution of 95.68 g of tetraethyl orthosilicate in 156.77 g of ethanol is added gradually via a dropping funnel. After the addition has ended, the reaction solution is kept at reflux while stirring for a further 4 h. The result is an opalescent dispersion. The mean particle size is 52 nm, as reported in FIG. 2.

EXAMPLE 2

Functionalization of the Surface of Nanoparticles with a Silanizing Reagent, These Having Been Produced by the Stöber Process According to Example 1

It is known that, according to the literature, for example, the between 4 and 4.6 SiOH groups per $nm^2$ are to be expected on $SiO_2$ surfaces (Thesis by M. Braun (Beiträge zur physikalisch-chemischen Charakterisierung funktionaler $SiO_2$-Oberflächen [Contributions to the physicochemical characterization of functional $SiO_2$ surfaces], TU Chemnitz, 2009)). Thus, for trialkoxyalkylsilanes or trialkoxyarylsilanes, somewhat more than one silane per $nm^2$ is required at the surface of the $SiO_2$ nanospheres to be functionalized. However, higher or lower amounts of silane can also be used.

Under the reasonable assumption that the particles are spherical, the specific surface area can be calculated in $m^2/g$:

$$\text{Surface area} = 3000/(\text{diameter of nanospheres in nanometers})$$

Figure 3:
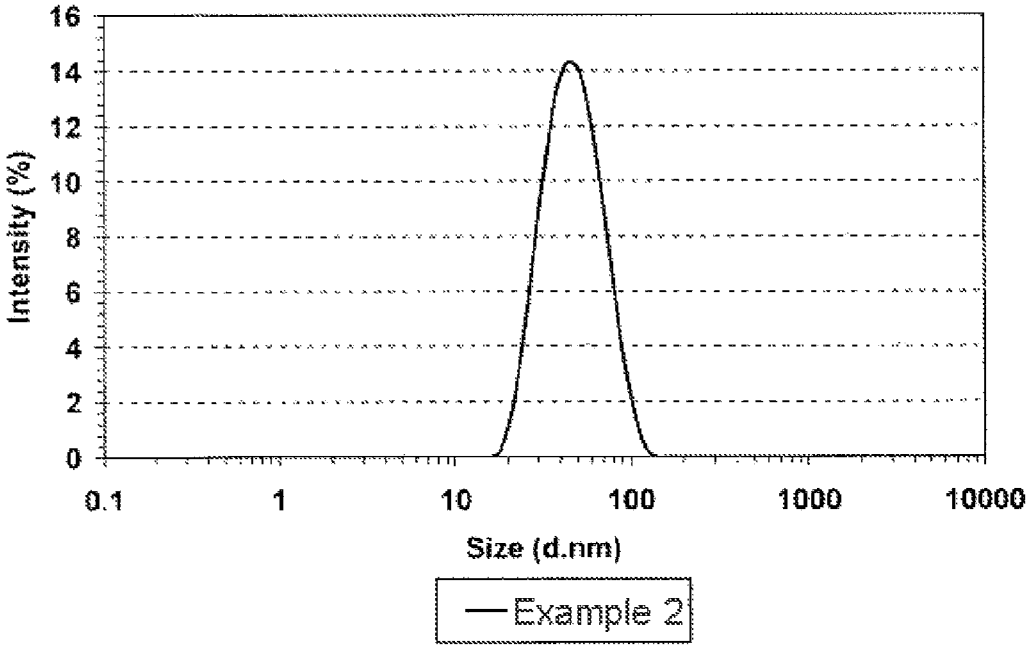
FIG. 3: particle size of the $SiO_2$ dispersion after functionalization with butylsilane, which has been determined by dynamic light scattering (example 2)

The dispersion produced in example 1 (277.87 g) is heated to 78° C. under reflux while stirring. On attainment of the temperature, 1.66 g of n-butyltrimethoxysilane are added all at once. The solution is kept at 78° C. while stirring for a further 8 h. FIG. 3 shows that the particle size distribution is maintained.

EXAMPLE 3

Figure 4:
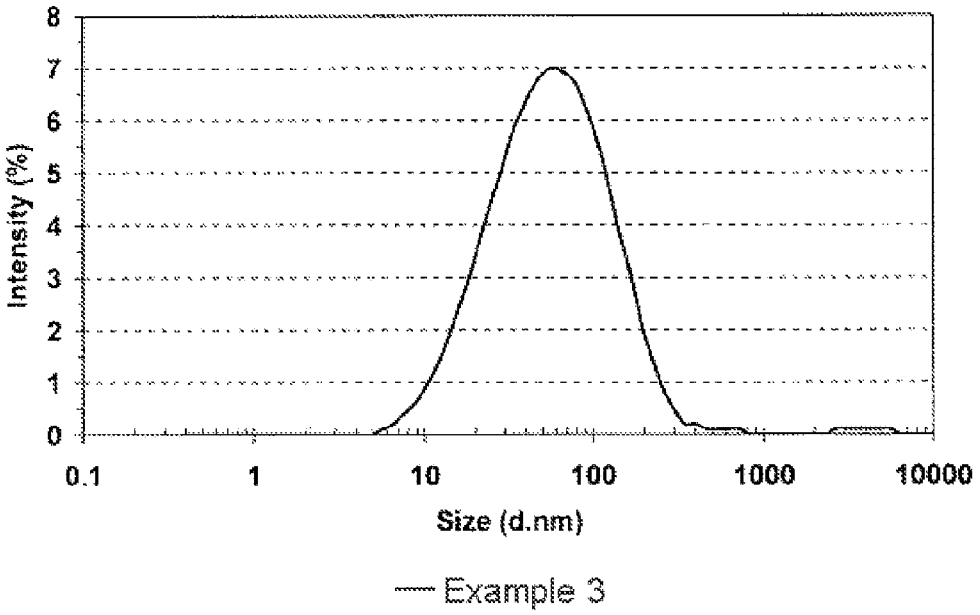
FIG. 4: particle size distribution in polyglycol (example 4)

Incorporation of the Functionalized Nanoparticles into Polyglycol 83.11 g of the dispersion of functionalized nanoparticles according to example 2, together with 28.10 g of water-miscible polyglycol (ethylene oxide and propylene oxide monomers; kinematic viscosity 100 $mm^2$/sec at 40° C.), are concentrated in a rotary evaporator while heating to 100° C. with an oil bath and applying a vacuum, for example with a water-jet pump. The result is a clear liquid. The high ratio of dispersion to oil is required in order to be able to establish concentrations of 10% nanoparticles in the polyglycol at the low concentration of $SiO_2$ particles inherent to the dispersions which are produced in the Stöber process. This dispersion can likewise be analyzed by dynamic light scattering, but has to be diluted for that purpose to a concentration of 1% $SiO_2$ by addition of the base oil. FIG. 4 shows that the particle size is maintained. The broadening of the peak can be explained by the higher viscosity of the polyglycol compared to the water/ethanol mixtures. The shift in the peak to greater particle diameters can be explained by the enlargement of the solvent shell, since the polyglycol molecules take up a greater amount of space at the particle surface than water or ethanol.

EXAMPLE 4

Rheological Properties of Modified Nanoparticles in Polyglycol

In accordance with the preceding examples, polyglycol dispersions which in all cases build upon the dispersion of example 1 are produced. The silanes used were, as well as butyltrimethoxysilane, also phenyltrimethoxysilane and triethoxy(octyl)silane. Modification was effected with one silane per $nm^2$, analogously to example 2. In all cases, the result is a clear liquid after redispersion. Table 1 shows that the kinematic viscosity has increased only slightly. The content of $SiO_2$ is also shown by the higher density.

Table 1 shows the data for the 10% dispersions of the butylsilane-, octylsilane- and phenylsilane-modified nanoparticles in polyglycol.

In addition, the dynamic viscosity of the nanoparticle-containing oils was determined as a function of the shear rate with a cone/plate system on the rheometer. The shear rate is increased logarithmically from 50 $sec^{-1}$ to 5000 $sec^{-1}$. In the case of the three dispersions described above, the dynamic viscosity remains independent of the shear rate; thus, newtonian flow characteristics are observed (see FIG. 5). In contrast, a 10% dispersion of Aerosil OX 50 (hydrophilic fumed silica, BET 35-65 $m^2$/g from Evonik, according to manufacturer data a mean primary particle size of 40 nm and hence similar to the nanoparticles examined) in the identical polyglycol shows a distinct decrease in the viscosity with shear (FIG. 5).

Figure 5:
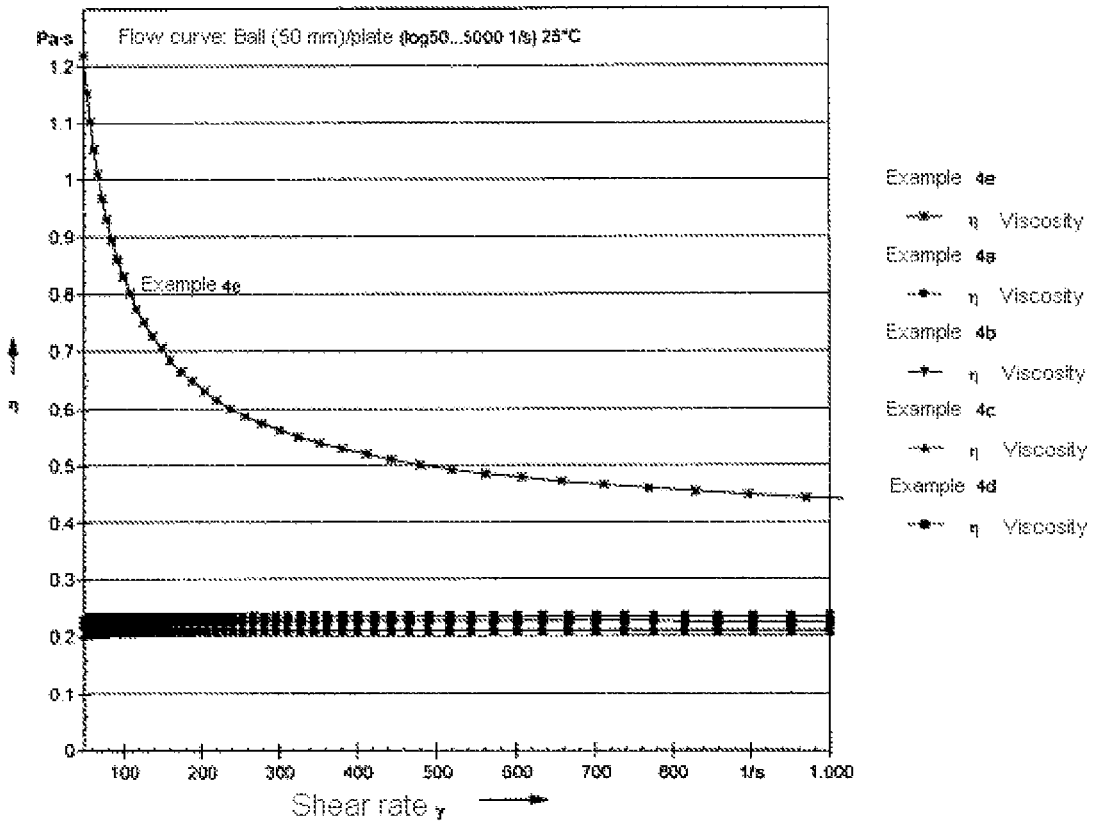
FIG. 5: the rheological properties of the nanoparticle-containing composition based on polyglycol as a function of the shear rate (examples 4a to d and comparative example 4e)

The Aerosil-containing mixture referred to as 4*e* in FIG. 5 thus shows a marked deviation from newtonian flow characteristics, which can be explained by an interaction of the unmodified particles.

EXAMPLE 5

Functionalization and Redispersion Proceeding from Levasil 200N/30%

404 g of Levasil 200N/30% are heated to about 85° C. while stirring. 395 g of ethanol and 11.78 g of butyltrimethoxysilane (corresponds to about 5 silane molecules per $nm^2$ of surface area) are added all at once and kept at the temperature for about 1 h while stirring. Even while heating, a gel-like consistency develops.

21.06 g of the gel are redispersed with 81.89 g of polyglycol oil as described above. The result is a clear liquid (about 3.8% $SiO_2$).

TABLE 1

| | Example 4a 10% $SiO_2$ nanoparticles, phenyl-modified, in polyglycol, approx. 100 $mm^2$/sec | Example 4b 10% $SiO_2$ nanoparticles, octyl-modified, in polyglycol, approx. 100 $mm^2$/sec | Example 4c 10% $SiO_2$ nanoparticles, butyl-modified, in polyglycol, approx. 100 $mm^2$/sec | Example 4c Polyglycol reference |
|---|---|---|---|---|
| Appearance | Clear liquid | Clear liquid | Clear liquid | Clear liquid |
| Stabinger viscometer | Instrument from Anton Paar, determination of the kinematic viscosity based on ASTM D 7042-04/ASTM D 4 | | | |
| Viscosity 40° C. ($mm^2$/s) | 116.05 | 103.5 | 117.32 | 103.79 |
| Viscosity 100° C. ($mm^2$/s) | 22.927 | 20.698 | 24.098 | 21.074 |
| VI | 228.7 | 222.6 | 238.5 | 230.6 |
| Density 40° C. ($g/cm^3$) | 1.0415 | 1.0409 | 1.0516 | 0.9877 |
| Density 100° C. ($g/cm^3$) | 0.9953 | 0.9949 | 1.0058 | 0.9334 |
| Density 15° C. ($g/cm^3$) | 1.057 | 1.0562 | 1.0669 | 1.0058 |
| Apparent dynamic viscosity (mPa · s) 50 mm cone/plate, shear rate 300 $sec^{-1}$ based on DIN 51810 | 235 | 210 | 225 | 196 |

TABLE 2

| | Example 5 3.8% butyl-functionalized $SiO_2$ nanoparticles in polyglycol oil | Reference example Pure polyglycol oil |
|---|---|---|
| Appearance | Clear liquid | Clear liquid |
| Stabinger viscometer | Instrument from Anton Paar, determination of the kinematic viscosity based on ASTM D 7042-04/ASTM D 4 | |
| Viscosity 40° C. ($mm^2/s$) | 106.08 | 103.79 |
| Viscosity 100° C. ($mm^2/s$) | 20.66 | 21.074 |
| VI | 221.2 | 230.6 |
| Density 40° C. ($g/cm^3$) | 1.0442 | 0.9877 |
| Density 100° C. ($g/cm^3$) | 0.9971 | 0.9334 |
| Density 15° C. ($g/cm^3$) | 1.0599 | 1.0058 |
| Apparent dynamic viscosity (mPa · s) 50 mm cone/plate, shear rate 300 $sec^{-1}$ based on DIN 51810 | 231 | 196 |

Table 2 shows that the rheological properties are little influenced by the nanoparticles. Thus, highly concentrated dispersions, such as Levasil, are also possible as the nanoparticle source.

EXAMPLE 6

To study the influence of the nanoparticles on friction and wear, a nanoparticle dispersion having a content of 1% $SiO_2$ is produced by dilution with base oil.

TABLE 3

| | | Reference example Polyglycol | Example 6 Polyglycol + 1% $SiO_2$ butyl-functionalized, particle diameter approx. 60 nm |
|---|---|---|---|
| Viscosity | | Stabinger based on ASTM D 7042-04/ASTM D 4 | |
| Stabinger | Viscosity 40° C. | 237.0 | 240.8 |
| | Viscosity 100° C. | 43.4 | 45.0 |
| | VI | 240.1 | 245.0 |
| | Density 40° C. | 1.040 | 1.046 |
| | Density 100° C. | 0.996 | 1.000 |
| | Density 20° C. | 1.055 | 1.061 |
| Rheometer Anton Paar | Apparent dynamic viscosity (mPa · s) | 482 | 493 |
| Oscillating frictional wear test 50N/30 s run-in, ball/disk; lapped; 130N; 2.2 mm; RT; 24 Hz; 40 µl, 60 min | | SRV, based on DIN 51834 | |
| | Run-in coefficient of friction min. | 0.131 | 0.131 |
| | Run-in coefficient of friction max. | 1.137 | 1.139 |
| | Coefficient of friction min. | 0.12 | 0.12 |
| | Coefficient of friction max. | 0.125 | 0.124 |
| | Wear factor | 46 | 80 |
| | Curve description | Gentle curve profile coefficient of friction at 0.12 | Gentle curve profile at coefficient of friction 0.13 |
| Four-ball apparatus | | VKA prolonged wear based on DIN 51350 T3, 800N, room temperature, 1 h | |
| Prolonged wear | Cup diameter (mm) | 0.73 | 0.99 |
| Four-ball apparatus | | Based on DIN 51350 T2 | |
| Weld load | Good load (N) | 1400 | 1800 |
| | Weld load (N) | 1600 | 2000 |
| | Cup diameter (mm) | 3 | 1.2 |

The nanoparticles in example 6 have a low, negligible influence on the rheological properties; in the VKA prolonged wear, there is a slight deterioration. In the SRV, the wear factor is increased somewhat; the coefficient of friction remains the same. In the case of the weld load, a slight improvement is observed.

The effect on friction and wear is thus dependent on the experimental conditions and can also lead to deteriorations. Thus, there is no effect as an antiwear additive.

EXAMPLE 7

Effect of the Modified Nanoparticles in a Polyglycol-Based Transmission Oil Formulation Transmission oil formulations were produced with $SiO_2$ particles having a butyl surface modification and of size 60 nm. For this purpose, a 10% dispersion of the modified nanoparticles in polyglycol was used, which can be stirred easily into the formulation. The concentration of the nanoparticles in the final formulation is 1%. The formulation was produced in two viscosity levels (100 and 220 cSt).

TABLE 4

| | Reference 220 cSt | Formulation comprising nanoparticles, 220 cSt | Reference ex. 100 cSt | Formulation comprising nanoparticles 100 cSt |
|---|---|---|---|---|
| Water-miscible polyglycol Ethylene oxide/propylene oxide monomers | 94.15 | 84.15 | 94.15 | 84.15 |

TABLE 4-continued

| | Reference 220 cSt | Formulation comprising nano-particles, 220 cSt | Reference ex. 100 cSt | Formulation comprising nano-particles 100 cSt |
|---|---|---|---|---|
| Antioxidant mixture | 3 | 3 | 3 | 3 |
| Antiwear additive | 2.3 | 2.3 | 2.3 | 2.3 |
| Anticorrosion additive | 0.305 | 0.305 | 0.305 | 0.305 |
| Antifoam, silicone-based | 0.2 | 0.2 | 0.2 | 0.2 |
| 10% dispersion of butyl-functionalized $SiO_2$ nanoparticles in polyglycol Particle size about 60 nm | | 10 | | 10 |

With the above-described compositions, a study was then conducted as to the effect of the use of nanoparticles with regard to micropitting capacity.

TABLE 5

| | Reference 220 cSt | Formulation comprising nanoparticles, 220 cSt | Reference ex. 100 cSt | Formulation comprising nanoparticles 100 cSt |
|---|---|---|---|---|
| Viscosity viscosity and density data | | | | |
| V 40° C. ($mm^2$/sec) | 236.7 | 238.7 | 98.3 | 106.5 |
| V 100° C. ($mm^2$/sec) | 41.3 | 41.7 | 19.4 | 19.9 |
| VI | 230.0 | 230.5 | 220.4 | 211.1 |
| Density 40° C. (g/ml) | 1.042 | 1.046 | 1.026 | 1.032 |
| FZG short micropitting test 2200 rpm. T = 90° C. | | | | |
| Change in weight Pinion/wheel Overall | 23 | 7 | 23 | 12 |
| Micropitting area after damage level 7 (average of 3 flanks) | 15.70% | 2.50% | 10% | 2.90% |
| Micropitting area after damage level 9 (average of 3 flanks) | 20% | 4.50% | 13.80% | 5.20% |
| Profile deviation after damage level 7 (average of 3 flanks) | 3.3 μm | 0 μm | 1.8 μm | 5.3 μm |
| Profile deviation after damage level 9 (average of 3 flanks) | 3.3 μm | 0 μm | 0 mm | 5 μm |
| | SKS GFKT < KS 9 Virtually no expectation of micropitting formation | SKS GFKT < KS 9 Virtually no expectation of micropitting formation | SKS GFKT < KS 9 Virtually no expectation of micropitting formation | SKS GFKT < KS 9 Virtually no expectation of micropitting formation |

As is apparent from table 5, micropitting formation is distinctly reduced when nanoparticles are used in a polyglycol transmission oil. Overall, it can be stated that the nanoparticles once again distinctly improved the micropitting capacity through the use of the two compositions which comprise the nanoparticles when they are present as an application to the surfaces of the drive elements, proceeding from a good level (100 cSt and 220 cSt references).

The invention claimed is:

1. A composition for prevention or reduction of fatigue damage, especially trench formation or micropitting, of the surfaces of drive elements, consisting of:

(a) 10 to 40% by weight of surface-modified oxidic nanoparticles selected from the group including silicon dioxide, zinc oxide and aluminum oxide nanoparticles, and (b) 90 to 60% by weight of a carrier material suitable for application to the drive element surfaces.

2. The composition as claimed in any of claim 1, wherein the nano-particles are surface-modified by a surface-modifying reagent comprising silanes selected from alkyl-, aryl- and alkylarylsilanes having at least 1 to 3 of these alkyl, aryl and alkylaryl groups and which may further comprise functional groups operable to react with metal surfaces such as thio groups, phosphate groups or combinations thereof.

3. The composition as claimed in claim 1, wherein the nano-particles are surface-modified by contacting the surface of said nano-particle with 0.1 to 10 molecules of the modifying reagent per $nm^2$ of the surface of the nano-particle.

4. The composition as claimed in claim 1, wherein the 10 to 40% by weight of nano-particles includes nanoparticles having both different substances and different particle sizes.

5. The composition as claimed in claim 1, wherein the surface-modified nanoparticles have a particle size of 10 nm to less than 200 nm, wherein the particle size is determined by dynamic light scattering in dispersion.

6. The composition as claimed in claim 1, wherein the carrier material present in the composition is selected from the group consisting of synthetic and native ester oils, polyglycols, synthetic hydrocarbon oils.

7. A method for prevention or reduction of fatigue damage, especially trench formation or micropitting, of the surfaces of a bearing, gear, transmission element or disc drive, comprising applying the composition of claim 1 to one or more surfaces of the drive element.

8. A method for prevention or reduction of fatigue damage, especially trench formation or micropitting, of the surfaces of a bearing, gear, transmission element or disc drive, comprising:

introducing the composition of claim 1 into a lubricant selected from the group of greases, pastes and oils; and applying the lubricant to one or more surfaces of the drive element.

* * * * *